US009437390B2

(12) United States Patent
Tomita et al.

(10) Patent No.: US 9,437,390 B2
(45) Date of Patent: Sep. 6, 2016

(54) X-RAY TUBE DEVICE

(71) Applicant: SHIMADZU CORPORATION, Kyoto (JP)

(72) Inventors: Sadamu Tomita, Kyoto (JP); Masaaki Ukita, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 29 days.

(21) Appl. No.: 14/437,491

(22) PCT Filed: Oct. 22, 2012

(86) PCT No.: PCT/JP2012/077215

§ 371 (c)(1),
(2) Date: Apr. 21, 2015

(87) PCT Pub. No.: WO2014/064748

PCT Pub. Date: May 1, 2014

(65) Prior Publication Data

US 2015/0287565 A1 Oct. 8, 2015

(51) Int. Cl.

| | |
|---|---|
| ***H01J 35/30*** | (2006.01) |
| ***H01J 35/14*** | (2006.01) |
| ***H01J 35/16*** | (2006.01) |

(52) U.S. Cl.

CPC ..... *H01J 35/14* (2013.01); *H01J 35/16* (2013.01); *H01J 35/305* (2013.01); *H01J 2235/02* (2013.01); *H01J 2235/16* (2013.01); *H01J 2235/168* (2013.01)

(58) Field of Classification Search

USPC ..... 378/119, 121, 137, 138

See application file for complete search history.

(56) References Cited

U.S. PATENT DOCUMENTS

| | | | | |
|---|---|---|---|---|
| 6,084,942 | A | 7/2000 | Hell et al. | |
| 6,975,704 | B2 * | 12/2005 | Neumeier | H01J 35/14 378/125 |

(Continued)

FOREIGN PATENT DOCUMENTS

| | | | |
|---|---|---|---|
| JP | 2006-047206 | A | 2/2006 |
| JP | 2008-234981 | A | 10/2008 |
| JP | 2009-021182 | A | 1/2009 |
| JP | 2009-081108 | A | 4/2009 |
| JP | 2010-021010 | A | 1/2010 |
| JP | 2010-021011 | A | 1/2010 |
| JP | 2010-080399 | A | 4/2010 |

(Continued)

OTHER PUBLICATIONS

International Search Report issued in International Application No. PCT/JP2012/077215 dated Nov. 20, 2012, with English Translation.

*Primary Examiner* — Bernard Souw

(74) *Attorney, Agent, or Firm* — McDermott Will & Emery LLP

(57) ABSTRACT

An X-ray tube device according to the present invention includes a cathode generating an electron beam, an anode generating an X-ray by collision of the electron beam from the cathode, an envelope internally housing the cathode and the anode, a magnetic field generator including a magnetic pole arranged to be opposed to the envelope, generating a magnetic field for focusing and deflecting the electron beam from the cathode to the anode, and an electric field relaxing electrode arranged between the magnetic pole and the envelope, having an outer surface having a rounded shape. Thus, the magnetic field generator can be placed closer to the envelope while a tip end of the magnetic field generator is suppressed from being a discharge start point, and hence the effect of being capable of downsizing the X-ray tube device is achieved.

20 Claims, 7 Drawing Sheets

(56) References Cited

U.S. PATENT DOCUMENTS

| | | | | |
|---|---|---|---|---|
| 8,213,576 | B2 * | 7/2012 | Tomita | H01J 35/14 378/137 |
| 2005/0157846 | A1 * | 7/2005 | Neumeier | H01J 35/14 378/137 |
| 2011/0135066 | A1 * | 6/2011 | Behling | H01J 35/10 378/138 |

FOREIGN PATENT DOCUMENTS

| | | | |
|---|---|---|---|
| JP | 2010-170718 | A | 8/2010 |
| JP | 2010-187981 | A | 9/2010 |
| JP | 2010-198744 | A | 9/2010 |
| JP | 2012-028133 | A | 2/2012 |
| JP | 2012-043555 | A | 3/2012 |
| WO | 2009/019791 | A1 | 2/2009 |

* cited by examiner

FIRST EMBODIMENT
(510-510 SECTION)

FIRST EMBODIMENT
(500-500 SECTION)

FIRST EMBODIMENT

EXAMPLE 1

EXAMPLE 2

COMPARATIVE EXAMPLE

X-RAY TUBE DEVICE

RELATED APPLICATIONS

This application is a national phase of International Application No. PCT/JP2012/077215, filed on Oct. 22, 2012, the disclosure of which Application is incorporated by reference herein.

TECHNICAL FIELD

The present invention relates to an X-ray tube device, and more particularly, it relates to an X-ray tube device including a magnetic field generator.

BACKGROUND ART

In general, an X-ray tube device including a magnetic field generator is known. Such an X-ray tube device is disclosed in U.S. Pat. No. 6,084,942, for example.

An X-ray tube device disclosed in the aforementioned U.S. Pat. No. 6,084,942 includes a tubular envelope, a cathode and an anode housed in the envelope, and a magnetic field generator arranged outside the tubular envelope. The cathode is provided with an electron source generating a thermoelectron, for example, and a filament current flows thereinto to generate an electron. Furthermore, a negative high voltage is applied to the cathode and a positive high voltage is applied to the anode and the envelope, whereby an electron beam is emitted from the cathode to the anode. The magnetic field generator has a rectangular sectional shape, and a deflecting voltage is applied thereto to generate a magnetic field from the outside of the envelope at a position between the cathode and the anode. Thus, the electron beam to the anode is deflected and is focused to the edge of the anode rotating together with the envelope. The electron beam impinges on the anode to generate an X-ray.

PRIOR ART

Patent Document

Patent Document 1: U.S. Pat. No. 6,084,942

SUMMARY OF THE INVENTION

Problem to be Solved by the Invention

In order to downsize the X-ray tube device, it is preferable to place the magnetic field generator closer to the envelope and allow the magnetic field to efficiently act on the electron beam. In the X-ray tube device according to the aforementioned U.S. Pat. No. 6,084,942, however, a potential difference between the envelope applied with a high voltage (tube voltage) and the magnetic field generator applied with the deflecting voltage is large, and hence when the magnetic field generator is placed closer to the envelope, electric field concentration is generated in a tip end of the magnetic field generator, and discharge starts from the tip end of the magnetic field generator. Thus, in the X-ray tube device according to the aforementioned U.S. Pat. No. 6,084,942, the magnetic field generator is required to be arranged at a position separated from the envelope by a distance capable of preventing discharge, and there is such a problem that it is difficult to place the magnetic field generator closer to the envelope.

The present invention has been proposed in order to solve the aforementioned problem, and an object of the present invention is to provide an X-ray tube device capable of placing a magnetic field generator closer to an envelope while suppressing a tip end of the magnetic field generator from being a discharge start point.

Means for Solving the Problem

In order to attain the aforementioned object, an X-ray tube device according to a first aspect of the present invention includes a cathode generating an electron beam, an anode generating an X-ray by collision of the electron beam from the cathode, an envelope internally housing the cathode and the anode, a magnetic field generator including a magnetic pole arranged to be opposed to the envelope, generating a magnetic field for focusing and deflecting the electron beam from the cathode to the anode, and an electric field relaxing electrode arranged between the magnetic pole and the envelope, having an outer surface having a rounded shape.

As hereinabove described, the X-ray tube device according to the first aspect of the present invention is provided with the electric field relaxing electrode arranged between the magnetic pole and the envelope, having the outer surface having the rounded shape, whereby the outer surface having the rounded shape of the electric field relaxing electrode is arranged between the magnetic pole (magnetic field generator) and the envelope, and hence electric field concentration in a tip end of the magnetic pole opposed to the envelope can be relaxed. Thus, the electric field concentration serving as a discharge start point can be relaxed even when the magnetic field generator is placed closer to the envelope, and hence the magnetic field generator can be placed closer to the envelope while a tip end of the magnetic field generator is suppressed from serving as the discharge start point. Consequently, the magnetic field of the magnetic field generator can efficiently act on the electron beam, and hence the X-ray tube device can be downsized by downsizing of the magnetic field generator itself and by placement of the magnetic field generator closer to the envelope.

In the aforementioned X-ray tube device according to the first aspect, the outer surface having the rounded shape of the electric field relaxing electrode is preferably arranged in the vicinity of a tip end of the magnetic pole. According to this structure, when the electric field relaxing electrode is placed closer to the envelope within a range between the electric field relaxing electrode and the envelope, in which no discharge occurs, the tip end of the magnetic pole is arranged close to the vicinity of the outer surface of the electric field relaxing electrode, so that the magnetic pole (magnetic field generator) can get closer to the envelope.

In this case, the tip end of the magnetic pole is preferably shaped to have a corner portion, and the outer surface having the rounded shape of the electric field relaxing electrode is preferably provided to cover at least the corner portion of the tip end of the magnetic pole. According to this structure, the corner portion of the tip end of the magnetic pole (magnetic field generator) where the electric field concentration is most easily generated can be covered with the outer surface having the rounded shape of the electric field relaxing electrode, and hence the electric field concentration can be efficiently relaxed.

In the structure in which the outer surface having the rounded shape of the electric field relaxing electrode covers at least the corner portion of the tip end of the magnetic pole, the electric field relaxing electrode is preferably provided to cover the corner portion of the tip end of the magnetic pole and a tip end surface and a side surface that intersect with each other at the corner portion of the magnetic pole. According to this structure, in addition to the corner portion of the tip end of the magnetic pole, the tip end surface and the side surface of the magnetic pole can be covered with the outer surface having the rounded shape of the electric field relaxing electrode, and hence the electric field concentration can be more efficiently relaxed.

In this case, the electric field relaxing electrode is preferably provided to tightly surround and cover the corner portion of the tip end of the magnetic pole and the tip end surface. According to this structure, the electric field relaxing electrode completely covers the corner portion of the tip end and the tip end surface of the magnetic pole, whereby the electric field concentration can be more reliably relaxed.

In the aforementioned X-ray tube device according to the first aspect, the electric field relaxing electrode is preferably made of non-magnetic metal. According to this structure, the magnetic field generated by the magnetic field generator can be suppressed from being shielded by the electric field relaxing electrode, and hence the magnetic field of the magnetic field generator can efficiently act on the electron beam.

In the aforementioned X-ray tube device according to the first aspect, the envelope preferably has a tubular shape housing the cathode and the anode, and the electric field relaxing electrode is preferably annularly provided to surround the envelope having the tubular shape. According to this structure, the envelope having the tubular shape is surrounded by the annular electric field relaxing electrode in a seamless manner, and hence electric field concentration in the electric field relaxing electrode can be relaxed.

In this case, the outer surface of a tip end of the electric field relaxing electrode that is annular is preferably formed in a convex rounded shape in a longitudinal section in a direction along a central axis line of the envelope having the tubular shape, and the outer surface of the tip end of the electric field relaxing electrode that is annular is preferably formed of a circular inner peripheral surface in a transverse section in a direction orthogonal to the central axis line of the envelope. According to this structure, the electric field relaxing electrode has the outer surface rounded with respect to the envelope in both the longitudinal section of the envelope along the direction along the central axis line and the transverse section in the direction orthogonal to the central axis line of the envelope, and hence the electric field concentration in the electric field relaxing electrode can be effectively relaxed.

In the aforementioned structure in which the electric field relaxing electrode is annularly provided to surround the envelope, a plurality of magnetic poles are preferably provided at prescribed angular intervals around the envelope, and the electric field relaxing electrode preferably includes the electric field relaxing electrode that is single and annular, provided to cover the plurality of magnetic poles. According to this structure, the plurality of magnetic poles can be collectively covered simply by providing the single electric field relaxing electrode, and an increase in the number of components can be suppressed as compared with the case where a plurality of electric field relaxing electrodes are provided individually.

In this case, the magnetic field generator preferably includes an annular core and the plurality of magnetic poles arranged to protrude inward from the annular core, a plurality of recess portions into which tip end portions of the plurality of magnetic poles are inserted are preferably provided in an outer peripheral portion of the electric field relaxing electrode that is annular, and the tip end portions of the plurality of magnetic poles are preferably covered with the electric field relaxing electrode that is annular by insertion of the plurality of magnetic poles into the plurality of recess portions of the electric field relaxing electrode that is annular. According to this structure, the single annular electric field relaxing electrode can be easily and reliably provided to cover the tip end portions of the plurality of magnetic poles.

In the aforementioned structure in which the electric field relaxing electrode is annularly provided to surround the envelope, the electric field relaxing electrode that is annular is preferably arranged concentrically to the envelope to surround the envelope. According to this structure, an interval between the envelope and the electric field relaxing electrode can be easily kept constant even in the case where the envelope rotation type X-ray tube device rotating the envelope about a central axis is configured, for example, and hence the electric field concentration in the electric field relaxing electrode can be more effectively relaxed.

In the aforementioned structure in which the electric field relaxing electrode is annularly provided to surround the envelope, the inner peripheral surface of the electric field relaxing electrode that is annular is preferably arranged such that a distance therefrom to the outer peripheral surface of the envelope is substantially constant. According to this structure, the field intensity can be rendered substantially constant over the entire circumference of the inner peripheral surface of the electric field relaxing electrode, and hence the electric field concentration in the electric field relaxing electrode can be further effectively relaxed.

In this case, the envelope having the tubular shape preferably has a circular outer peripheral surface in a transverse section in a direction orthogonal to a central axis line of the envelope, and the inner peripheral surface of the electric field relaxing electrode that is annular preferably has a circular shape and is arranged such that the distance therefrom to the outer peripheral surface of the envelope is substantially constant. According to this structure, the distance from the inner peripheral surface of the electric field relaxing electrode to the outer peripheral surface of the envelope can be easily kept substantially constant, and the inner peripheral surface of the electric field relaxing electrode can be formed in a rounded shape (circular shape) having no corner along a circumferential direction.

In the aforementioned X-ray tube device according to the first aspect, the electric field relaxing electrode preferably has a convex outer surface, and the convex outer surface of the electric field relaxing electrode preferably includes an arcuate portion covering a tip end surface of the magnetic pole. According to this structure, the electric field relaxing electrode can be generally easily formed even in the case where the outer surface of the electric field relaxing electrode is formed in a convex shape in accordance with the magnetic pole in the form of a rectangular column.

In this case, the arcuate portion of the electric field relaxing electrode preferably has a curvature radius larger than a half of the length of the magnetic pole in a direction along the orientation of the electron beam. According to this structure, the arcuate portion of the electric field relaxing electrode can cover the tip end surface of the magnetic pole, and hence the electric field concentration in the tip end of the magnetic pole can be effectively relaxed.

In the aforementioned X-ray tube device according to the first aspect, the outer surface of a tip end of the electric field relaxing electrode preferably has a shape corresponding to the outer shape of the envelope in a direction along the orientation of the electron beam. According to this structure, a change in a distance between the outer surface of the electric field relaxing electrode and the outer surface of the envelope in the direction along the orientation of the electron beam can be suppressed, and hence the electric field concentration in the electric field relaxing electrode in the direction along the orientation of the electron beam can be effectively relaxed.

In this case, the envelope preferably has a tubular shape having a circular section and has an inclined surface inclined such that a diameter outward in a direction along a central axis line is larger, and the outer surface of the tip end of the electric field relaxing electrode preferably has a sectional shape in which an arcuate portion covering a tip end surface of the magnetic pole and an inclined portion extending substantially parallel to the inclined surface smoothly continue in a longitudinal section of the envelope in the direction along the central axis line. According to this structure, the arcuate portion of the electric field relaxing electrode can relax the electric field concentration in the tip end of the magnetic pole, and the inclined portion of the electric field relaxing electrode smoothly continuing to the arcuate portion is substantially parallel to the inclined surface of the envelope, and hence the electric field concentration on the outer surface of the electric field relaxing electrode can be further effectively relaxed.

In the aforementioned X-ray tube device according to the first aspect, a coil is preferably wound around a base portion side of the magnetic pole, and the electric field relaxing electrode preferably covers a tip end portion of the magnetic pole around which the coil is not wound. According to this structure, the electric field relaxing electrode does not interfere with the coil even in the case where the electric field relaxing electrode is provided. Furthermore, as described above, according to the present invention, the magnetic pole (magnetic field generator) can be placed closer to the envelope, and hence the coil for obtaining an intended magnetic field can be reduced in size. Therefore, the downsized coil can be arranged only on the base side of the magnetic pole, and the electric field relaxing electrode can easily cover the magnetic pole.

In the aforementioned X-ray tube device according to the first aspect, the electric field relaxing electrode is preferably arranged to cover at least a tip end surface of the magnetic pole, and a distance between the outer surface of the electric field relaxing electrode and the tip end surface of the magnetic pole is preferably not more than the length of the magnetic pole in a direction along the orientation of the electron beam. According to this structure, the magnetic pole can be placed closer to the envelope as the distance between the outer surface of the electric field relaxing electrode and the tip end surface of the magnetic pole is reduced, and hence the magnetic pole can be placed closer to the envelope as much as possible. Thus, the magnetic field generator can be downsized, and the entire X-ray tube device can be downsized.

In the aforementioned X-ray tube device according to the first aspect, the envelope preferably has a tubular shape housing the cathode and the anode centering on an axis and rotates integrally with the anode. According to this structure, the envelope rotation type X-ray tube device capable of placing the magnetic field generator closer to the envelope while suppressing the tip end of the magnetic field generator from being the discharge start point can be obtained.

Effect of the Invention

As hereinabove described, according to the present invention, the X-ray tube device capable of placing the magnetic field generator closer to the envelope while suppressing the tip end of the magnetic field generator from being the discharge start point can be provided.

MODES FOR CARRYING OUT THE INVENTION

Embodiments are hereinafter described on the basis of the drawings.

First Embodiment

The structure of an X-ray tube device 100 according to a first embodiment is now described with reference to FIGS. 1 to 3.

Figure 1:
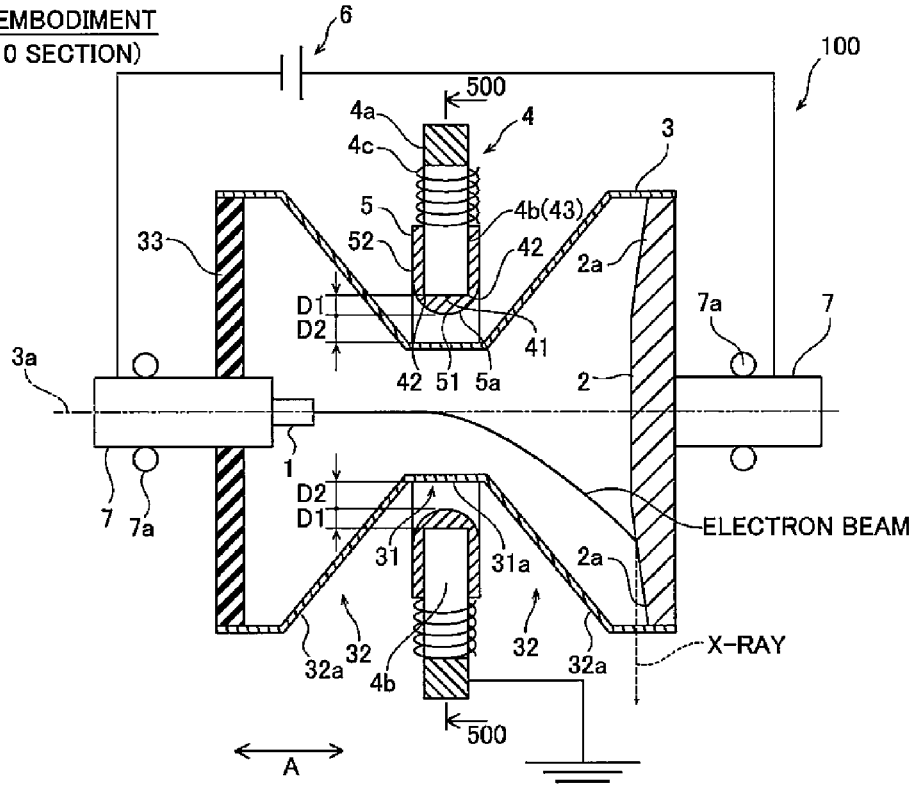
FIG. 1 A schematic longitudinal sectional view showing the overall structure of an X-ray tube device according to a first embodiment of the present invention, taken along the line 510-510 in FIG. 2.
Figure 2:
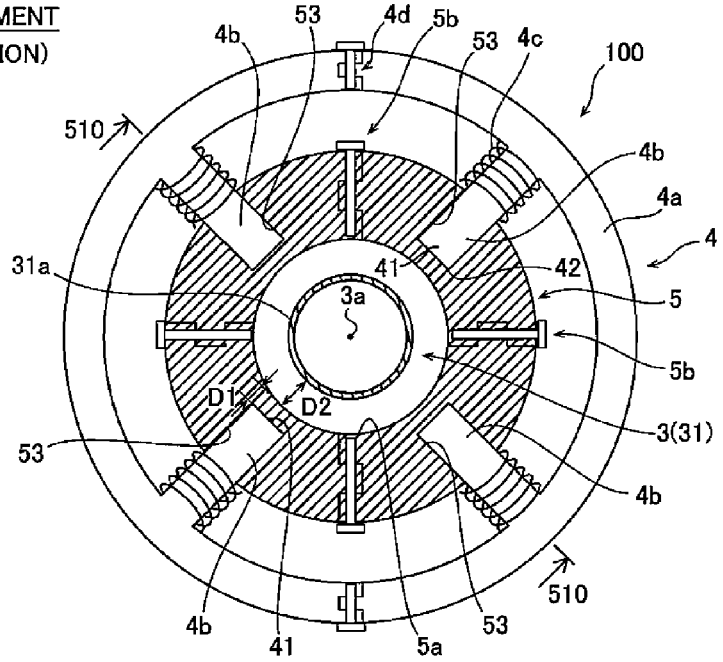
FIG. 2 A schematic transverse sectional view showing the overall structure of the X-ray tube device according to the first embodiment of the present invention, taken along the line 500-500 in FIG. 1.

The X-ray tube device 100 includes an electron source 1 generating an electron beam, a target 2, an envelope 3 internally housing the electron source 1 and the target 2, a magnetic field generator 4 provided outside the envelope 3, and a single electric field relaxing electrode 5 provided between the envelope 3 and the magnetic field generator 4, as shown in FIGS. 1 and 2. According to the first embodiment, the X-ray tube device 100 is a rotating anode X-ray tube device in which the target 2 rotates, and more specifically an envelope rotation type X-ray tube device in which the envelope 3 rotates integrally with the target 2. The electron source 1 and the target 2 are examples of the "cathode" and the "anode" in the present invention, respectively.

The electron source 1 is fixedly mounted on one end of the envelope 3 in an axial direction (direction A) through an insulating member 33. The electron source 1 is arranged on the rotation axis 3*a* of the envelope 3 and is configured to rotate integrally with the envelope 3 about the rotation axis 3*a*.

The target 2 is integrally (fixedly) mounted on the other end of the envelope 3 in the axial direction (direction A) to be opposed to the electron source 1. The target 2 has a disc shape inclined such that an edge 2*a* is thinned outward. The center of the target 2 having the disc shape coincides with the rotation axis 3*a* of the envelope 3, and the target 2 is configured to rotate integrally with the envelope 3 about the rotation axis 3*a*.

The target 2 and the electron source 1 are connected to a positive terminal and a negative terminal of a power source portion 6, respectively. A positive high voltage is applied to the target 2, and a negative high voltage is applied to the electron source 1, whereby the electron beam is generated from the electron source 1 toward the target 2 along the rotation axis 3*a* (axial direction A).

The envelope 3 has a tubular shape extending in the axial direction A centering on the rotation axis (central axis) 3*a*. The envelope 3 having the tubular shape includes a cylindrical portion 31 located at the center in the axial direction A and inclined portions 32 inclined such that the diameter is increased toward both ends in the axial direction A. The envelope 3 is supported by shafts 7 and bearings 7*a* provided on both ends to be rotatable about the rotation axis (central axis) 3*a*. The envelope 3 is drivingly rotated by an unshown motor coupled to the shaft 7. One end of the envelope 3 is sealed by the disc-shaped insulating member 33, and the other end of the envelope 3 is sealed by the target 2. The inside of the envelope 3 is evacuated. The diameters of the insulating member 33 and the target 2 are the same, and the envelope 3 is bilaterally symmetric in a longitudinal section (a 510-510 section in FIG. 2, see FIG. 1) taken along the rotation axis 3*a* (central axis). The envelope 3 is made of a non-magnetic metal material such as stainless steel (SUS), and the insulating member 33 is made of an insulating material such as ceramic.

The target 2 is integrally mounted on the envelope 3, and hence the envelope 3 has the same potential as that of the target 2 applied with a positive high voltage. On the other hand, a portion between the electron source 1 and the envelope 3 is insulated by the insulating member 33. The diameter of the insulating member 33 is set to a size enabling sufficient insulation between the electron source 1 and the envelope 3.

The magnetic field generator 4 includes an annular core 4*a*, a plurality of magnetic poles 4*b* arranged to be opposed to the envelope 3, and a plurality of coils 4*c* wound around the respective magnetic poles 4*b*. The magnetic field generator 4 has a function of generating a magnetic field for focusing and deflecting the electron beam from the electron source 1 toward the target 2. The magnetic field generator 4 is arranged at a central position in the axial direction A with respect to the envelope 3 and is annularly provided to surround the cylindrical portion 31 of the envelope 3.

As shown in FIGS. 1 and 2, the core 4*a* has an annular shape concentric to the rotation axis 3*a* of the envelope 3. Four magnetic poles 4*b* are arranged at equal angular intervals (about 90 degrees) to protrude inward from the annular core 4*a* surrounding the envelope 3 (cylindrical portion 31). Therefore, the four magnetic poles 4*b* are opposed to each other in pairs through the center (rotation axis 3*a*) of the core 4*a*. The core 4*a* and the magnetic poles 4*b* are made of a magnetic material having high magnetic permeability such as iron and are grounded. Thus, a large potential difference is generated between the envelope 3 and the magnetic poles 4*b* of the magnetic field generator 4.

Figure 3:
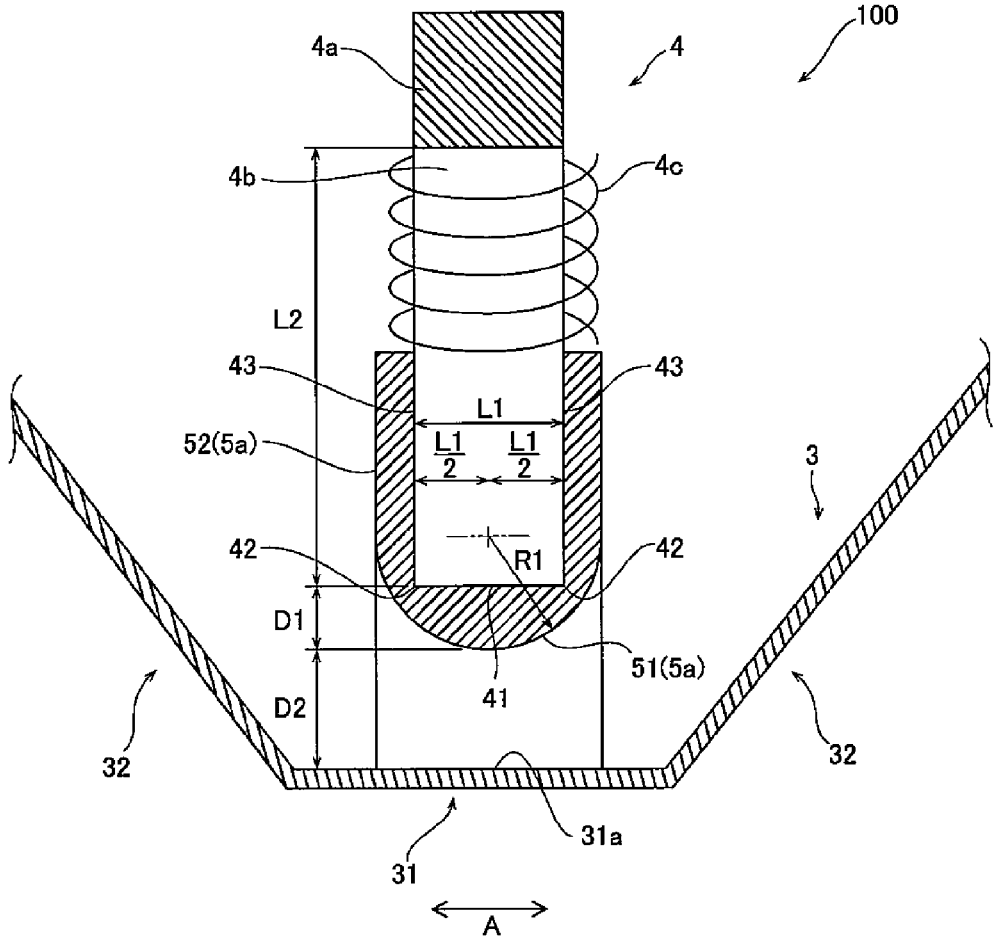
FIG. 3 A partial enlarged view for illustrating an electric field relaxation electrode of the X-ray tube device shown in FIG. 1.

As shown in FIG. 3, the magnetic poles 4*b* each are in the form of a rectangular column having a tip end surface 41, corner portions 42 of a tip end, and side surfaces 43 orthogonal to the tip end surface 41 at the corner portions 42. Specifically, the tip end surface 41 of each of the magnetic poles 4*b* is in the form of a square having a length L1 on a side. Therefore, the corner portions 42 are provided at respective four corners of the tip end surface 41. The side surfaces 43 each have a length L2. As described later, substantially half portions of the magnetic poles 4*b* closer to the tip ends are covered with the electric field relaxing electrode 5. The coils 4*c* are wound around substantially half portions of the magnetic poles 4*b* closer to base portions (closer to the core 4*a*). The magnetic field generator 4 generates the magnetic field from the tip ends of the magnetic poles 4*b* by power distribution to the coils 4*c*. As shown in FIG. 1, due to the action of the magnetic field generated from the magnetic field generator 4, the electron beam to the target 2 along the axial direction A is focused and deflected and impinges on the inclined edge 2*a* of the target 2. Consequently, an X-ray is generated from the edge 2*a* of the target 2 and is externally emitted through an unshown window portion of the envelope 3.

The electric field relaxing electrode 5 is provided to relax electric field concentration in the vicinity of the tip ends of the magnetic poles 4*b*. According to the first embodiment, the electric field relaxing electrode 5 has an annular shape, is arranged between the four magnetic poles 4*b* and the envelope 3, and has a rounded outer surface 5*a*, as shown in FIGS. 1 and 2. The electric field relaxing electrode 5 is made of non-magnetic metal, and the inside is solid. As the non-magnetic metal employed for the electric field relaxing electrode 5, metal having high voltage resistance is preferable, and stainless steel (SUS), titanium, or the like is preferable, for example. In the electric field relaxing electrode 5, the rounded outer surface 5*a* is arranged in the vicinity of the tip ends of the magnetic poles 4*b*, and the electric field relaxing electrode 5 is provided to tightly surround and cover the corner portions 42, the tip end surfaces 41, and the side surfaces 43 of the magnetic poles 4*b* closer to the tip ends. The electric field relaxing electrode 5 is grounded through the magnetic poles 4*b*.

More specifically, the electric field relaxing electrode 5 has a convex rounded shape in the longitudinal section (the 510-510 section in FIG. 2) in a direction along the rotation axis (central axis) 3*a* of the envelope 3, as shown in FIGS. 1 and 3. According to the first embodiment, the outer surface 5*a* of the electric field relaxing electrode 5 has a substantially U-shaped section in which an arcuate portion 51 of a tip end and straight portions 52 extending along the side surfaces 43 of the magnetic poles 4*b* smoothly continue. The arcuate portion 51 of the tip end has a curvature radius R1 larger than a half (L½) of the length L1 of each of the magnetic poles 4*b* in a direction (axial direction A) along the orientation of the electron beam. A distance D1 between the outer surface 5*a* (the outer surface of the arcuate portion 51) of the tip portion of the electric field relaxing electrode 5 and the tip end surfaces 41 of the magnetic poles 4*b* is not more than the length L1 of each of the magnetic poles 4*b* in the axial direction A.

As shown in FIG. 2, the electric field relaxing electrode 5 is annularly provided to cover all the four magnetic poles 4*b* in a transverse section (a 500-500 section in FIG. 1) in a direction orthogonal to the rotation axis (central axis) 3*a*, and the outer surface 5*a* of the tip end of the electric field relaxing electrode 5 is formed of a circular inner peripheral surface. The center of the annular electric field relaxing electrode 5 coincides with the rotation axis (central axis) 3*a* of the envelope 3. Therefore, the annular electric field relaxing electrode 5 is concentrically arranged to surround the envelope 3 (cylindrical portion 31). The inner peripheral surface (outer surface 5*a*) of the electric field relaxing electrode 5 is arranged such that a distance D2 therefrom to the outer peripheral surface 31*a* of the cylindrical portion 31 of the envelope 3 is substantially constant. An outer peripheral portion of the electric field relaxing electrode 5 is provided with four recess portions 53 for inserting tip end portions of the four magnetic poles 4*b* at equal angular intervals corresponding to the magnetic poles 4*b*. The four magnetic poles 4*b* are inserted into the respective four recess portions 53, whereby the tip end portions of the magnetic poles 4*b* are covered with the annular electric field relaxing electrode 5. The electric field relaxing electrode 5 is configured to cover the tip end portions of the magnetic poles 4*b* around which the coils 4*c* are not wound.

The annular core 4*a* and the annular electric field relaxing electrode 5 have divided structures coupled by coupling portions 4*d* and 5*b*, respectively. The coupling portions 4*d* and 5*b* each have a fitting structure in which one is convex and the other is concave, and the coupling portions 4*d* (5*b*) are screwed perpendicularly to a fitting direction in a state where the same are fitted. Thus, the divided core 4*a* and electric field relaxing electrode 5 are annularly provided around the envelope 3. Although FIG. 2 shows that the core 4*a* is divided in two and the electric field relaxing electrode 5 is divided in four, the division numbers are not limited to this but are arbitrary.

According to the first embodiment, as hereinabove described, the X-ray tube device 100 is provided with the electric field relaxing electrode 5 arranged between the magnetic poles 4*b* and the envelope 3, having the rounded outer surface 5*a*, whereby the rounded outer surface 5*a* of the electric field relaxing electrode 5 is arranged between the magnetic poles 4*b* (magnetic field generator 4) and the envelope 3, and hence the electric field concentration in the tip ends of the magnetic poles 4*b* opposed to the envelope 3 can be relaxed. Thus, the electric field concentration serving as a discharge start point can be relaxed even when the tip ends (magnetic poles 4*b*) of the magnetic field generator 4 are placed closer to the envelope 3, and hence the magnetic field generator 4 can be placed closer to the envelope 3 while the tip ends of the magnetic field generator 4 are suppressed from serving as the discharge start point. Consequently, the magnetic field of the magnetic field generator 4 can efficiently act on the electron beam, and hence the X-ray tube device 100 can be downsized by downsizing of the magnetic field generator 4 itself and by placement of the magnetic field generator 4 closer to the envelope 3.

According to the first embodiment, as hereinabove described, the rounded outer surface 5*a* of the electric field relaxing electrode 5 is arranged in the vicinity of the tip ends of the magnetic poles 4*b*. According to this structure, when the electric field relaxing electrode 5 is placed closer to the envelope 3 within a range between the electric field relaxing electrode 5 and the envelope 3, in which no discharge occurs, the tip ends of the magnetic poles 4*b* are arranged close to the vicinity of the outer surface 5*a* of the electric field relaxing electrode 5, so that the magnetic poles 4*b* (magnetic field generator 4) can get closer to the envelope 3.

According to the first embodiment, as hereinabove described, the electric field electrode 5 is provided to cover the corner portions 42 of the tip ends of the magnetic poles 4*b* and the tip end surfaces 41 and the side surfaces 43 of the magnetic poles 4*b*. According to this structure, the corner portions 42 of the tip ends of the magnetic poles 4*b* (magnetic field generator 4) where the electric field concentration is easily generated can be covered with the rounded outer surface 5*a* of the electric field relaxing electrode 5. In addition to the corner portions 42 of the tip ends of the magnetic poles 4*b*, the tip end surfaces 41 and the side surfaces 43 of the magnetic poles 4*b* can be covered with the rounded outer surface 5*a* of the electric field relaxing electrode 5, and hence the electric field concentration can be more efficiently relaxed.

According to the first embodiment, as hereinabove described, the electric field relaxing electrode 5 is provided to tightly surround and cover the corner portions 42 of the tip ends and the tip end surfaces 41 of the magnetic poles 4*b*. According to this structure, the electric field relaxing electrode 5 completely covers the corner portions 42 of the tip ends and the tip end surfaces 41 of the magnetic poles 4*b*, whereby the electric field concentration can be more reliably relaxed.

According to the first embodiment, as hereinabove described, the electric field relaxing electrode 5 is made of the non-magnetic metal. According to this structure, the magnetic field generated by the magnetic field generator 4 can be suppressed from being shielded by the electric field relaxing electrode 5, and hence the magnetic field of the magnetic field generator 4 can efficiently act on the electron beam.

According to the first embodiment, as hereinabove described, the electric field relaxing electrode 5 is annularly provided to surround the tubular envelope 3. According to this structure, the tubular envelope 3 is surrounded by the annular electric field relaxing electrode 5 in a seamless manner, and hence electric field concentration in the electric field relaxing electrode 5 can be relaxed.

According to the first embodiment, as hereinabove described, the outer surface 5*a* of the tip end of the electric field relaxing electrode 5 is convex and rounded substantially U-shaped in the longitudinal section (the 510-510 section in FIG. 2) of the tubular envelope 3 along the axial direction A, and the outer surface 5*a* of the tip end of the electric field relaxing electrode 5 is formed of the circular inner peripheral surface in the transverse section (the 500-500 section in FIG. 1) orthogonal to the axial direction A. According to this structure, the electric field relaxing electrode 5 has the outer surface 5*a* rounded with respect to the envelope 3 in both the longitudinal section along the axial direction A and the transverse section orthogonal to the axial direction A, and hence the electric field concentration in the electric field relaxing electrode 5 can be effectively relaxed.

According to the first embodiment, as hereinabove described, the single annular electric field relaxing electrode 5 is provided to cover the plurality of magnetic poles 4*b*. According to this structure, the plurality of magnetic poles 4*b* can be collectively covered simply by providing the single electric field relaxing electrode 5, and an increase in the number of components can be suppressed as compared with the case where a plurality of electric field relaxing electrodes 5 are provided individually.

According to the first embodiment, as hereinabove described, the annular electric field relaxing electrode 5 covers the tip end portions of the magnetic poles 4*b* by inserting the plurality of magnetic poles 4*b* into the respective four recess portions 53 provided in the outer peripheral portion of the annular electric field relaxing electrode 5. According to this structure, the single annular electric field relaxing electrode 5 covering the tip end portions of the plurality of magnetic poles 4*b* can be easily and reliably provided.

According to the first embodiment, as hereinabove described, the annular electric field relaxing electrode 5 is arranged concentrically to the envelope 3 to surround the envelope 3. According to this structure, an interval between the envelope 3 and the electric field relaxing electrode 5 can be easily kept constant even in the case where the envelope rotation type X-ray tube device 100 is configured, and hence the electric field concentration in the electric field relaxing electrode 5 can be more effectively relaxed.

According to the first embodiment, as hereinabove described, the inner peripheral surface of the annular electric field relaxing electrode 5 is arranged such that the distance D2 therefrom to the outer peripheral surface 31*a* of the envelope 3 is substantially constant. According to this structure, the field intensity can be rendered substantially constant over the entire circumference of the inner peripheral surface (the outer surface 5*a* on the tip end side) of the electric field relaxing electrode 5, and hence the electric field concentration in the electric field relaxing electrode 5 can be further effectively relaxed.

According to the first embodiment, as hereinabove described, the inner peripheral surface of the annular electric field relaxing electrode 5 has a circular shape in the transverse section (the 500-500 section in FIG. 1) orthogonal to the axial direction A and is arranged such that the distance D2 therefrom to the outer peripheral surface 31*a* of the envelope 3 is substantially constant. According to this structure, the distance D2 from the inner peripheral surface of the electric field relaxing electrode 5 to the outer peripheral surface 31*a* of the envelope 3 can be easily kept substantially constant, and the inner peripheral surface of the electric field relaxing electrode 5 can be formed in a rounded shape (circular shape) having no corner along a circumferential direction.

According to the first embodiment, as hereinabove described, the arcuate portion 51 covering the tip end surfaces 41 of the magnetic poles 4*b* is provided in the convex outer surface 5*a* of the electric field relaxing electrode 5. According to this structure, the electric field relaxing electrode 5 can be generally easily formed even in the case where the outer surface 5*a* of the electric field relaxing electrode 5 is formed in a convex shape in accordance with the magnetic poles 4*b* in the form of a rectangular column.

According to the first embodiment, as hereinabove described, the arcuate portion 51 of the electric field relaxing electrode 5 has the curvature radius R1 larger than a half (L½) of the length L1 of each of the magnetic poles 4*b* in the direction (axial direction A) along the orientation of the electron beam. According to this structure, the arcuate portion 51 of the electric field relaxing electrode 5 can cover the tip end surfaces 41 of the magnetic poles 4*b*, and hence the electric field concentration in the tip ends of the magnetic poles 4*b* can be effectively relaxed.

According to the first embodiment, as hereinabove described, the electric field relaxing electrode 5 is configured to cover the tip end portions of the magnetic poles 4*b* around which the coils 4*c* are not wound. According to this structure, the electric field relaxing electrode 5 does not interfere with the coils 4*c* even in the case where the electric field relaxing electrode 5 is provided. Furthermore, as described above, according to the first embodiment, the magnetic poles 4*b* (magnetic field generator 4) can be placed closer to the envelope 3, and hence the coils 4*c* for obtaining an intended magnetic field can be reduced in size. Therefore, the downsized coils 4*c* can be arranged only on the base sides of the magnetic poles 4*b*, and the electric field relaxing electrode 5 can easily cover the magnetic poles 4*b*.

According to the first embodiment, as hereinabove described, the distance D1 between the outer surface 5*a* of the electric field relaxing electrode 5 and the tip end surfaces 41 of the magnetic poles 4*b* is not more than the length L1 of each of the magnetic poles 4*b* in the direction (axial direction A) along the orientation of the electron beam. According to this structure, the magnetic poles 4*b* can be placed closer to the envelope 3 as the distance D1 between the outer surface 5*a* and the tip end surfaces 41 is reduced, and hence the magnetic poles 4*b* can be placed closer to the envelope 3 as much as possible. Thus, the magnetic field generator 4 can be downsized, and the entire X-ray tube device 100 can be downsized.

According to the first embodiment, as hereinabove described, the envelope 3 is formed in the tubular shape housing the electron source 1 and the target 2 centering on the rotation axis 3*a* and is configured to rotate integrally with the target 2. According to this structure, the envelope rotation type X-ray tube device 100 capable of relaxing the electric field concentration and placing the magnetic field generator 4 closer to the envelope 3 while suppressing the tip end of the magnetic field generator 4 from being the discharge start point can be obtained.

Second Embodiment

An X-ray tube device 200 according to a second embodiment of the present invention is now described with reference to FIGS. 4 to 6. In the second embodiment, an example of forming the outer surface 105*a* of an electric field relaxing electrode 105 in a shape corresponding to the shape of an envelope 3 is described unlike the aforementioned first embodiment in which the outer surface 5*a* of the electric field relaxing electrode 5 is formed in the substantially U-shaped sectional shape. In the second embodiment, portions identical to the X-ray device 100 according to the aforementioned first embodiment are denoted by the same reference numerals, to omit the description.

Figure 4:
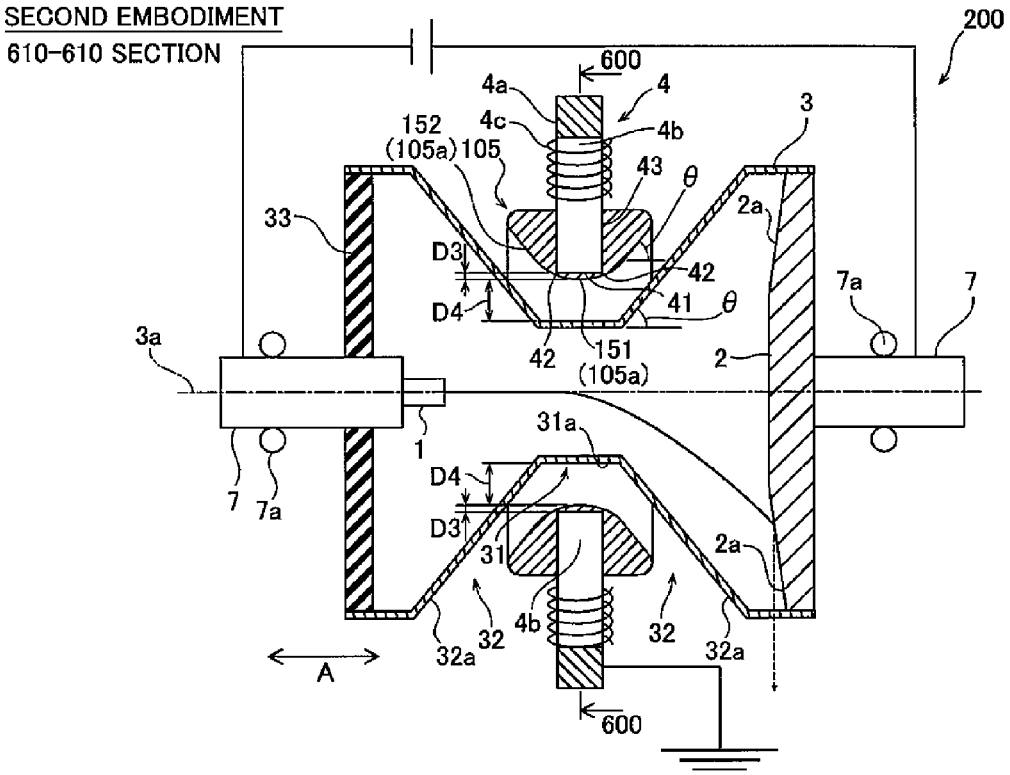
FIG. 4 A schematic longitudinal sectional view showing the overall structure of an X-ray tube device according to a second embodiment of the present invention, taken along the line 610-610 in FIG. 5.
Figure 5:
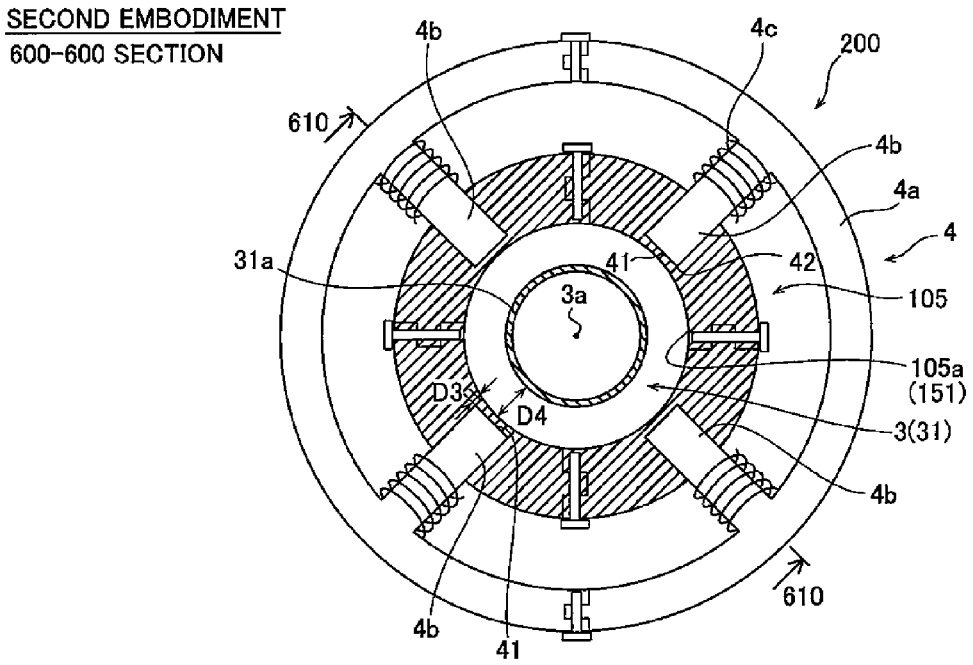
FIG. 5 A schematic transverse sectional view showing the overall structure of the X-ray tube device according to the second embodiment of the present invention, taken along the line 600-600 in FIG. 4.
Figure 6:
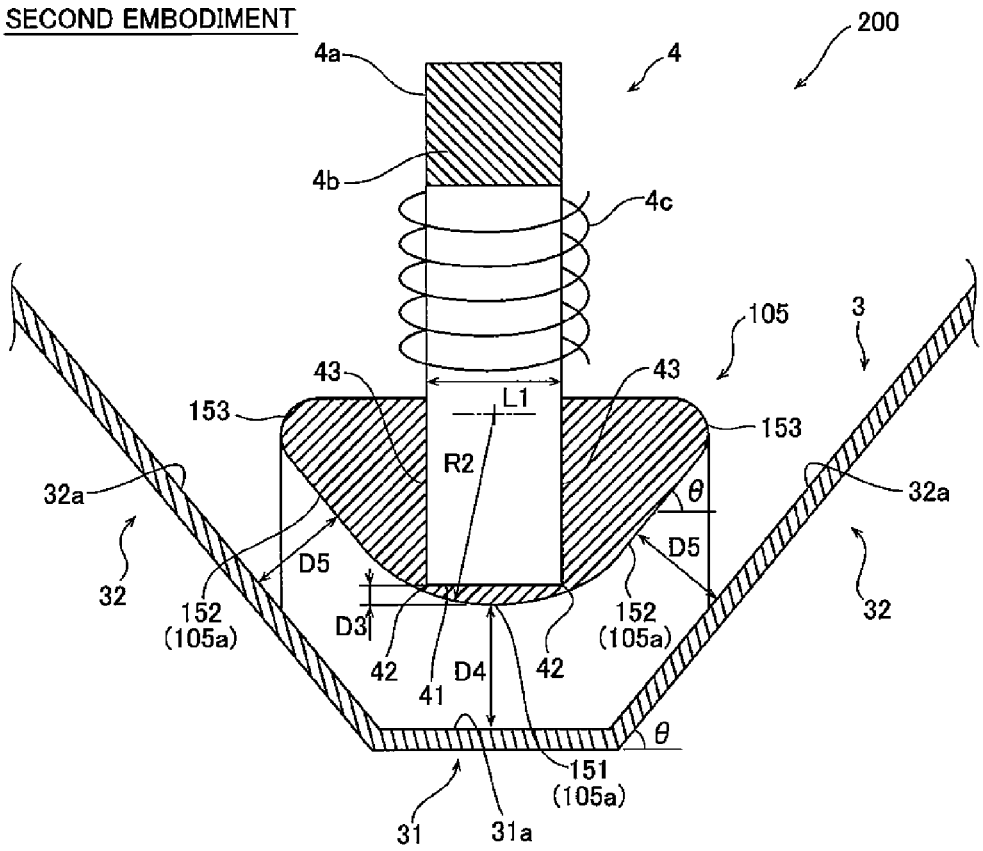
FIG. 6 A partial enlarged view for illustrating an electric field relaxation electrode of the X-ray tube device shown in FIG. 4.

As shown in FIGS. 4 and 5, the electric field relaxing electrode 105 of the X-ray tube device 200 according to the second embodiment has a shape corresponding to the outer shape of the envelope 3 in an axial direction A. Specifically, the outer surface 105*a* of a tip end of the electric field relaxing electrode 105 has a sectional shape in which an arcuate portion 151 covering tip end surfaces 41 of magnetic poles 4*b* and inclined portions 152 extending substantially parallel to inclined surfaces 32*a* (the outer peripheral surfaces of inclined portions 32) of the envelope 3 smoothly continue in a longitudinal section of the envelope 3 in a direction along the axial direction A, as shown in FIG. 6.

The arcuate portion 151 has a curvature radius R2 larger than a half (L½) of a length L1 of each of the magnetic poles 4*b* in the axial direction A. The curvature radius R2 is larger than the curvature radius R1 of the arcuate portion 51 of the electric field relaxing electrode 5 according to the aforementioned first embodiment. The curvature radius R2 is set to a size enabling smooth continuation of the outer surface 105*a* to ends of the inclined portions 152 closer to the tip end on both sides in the axial direction A. The curvature radius of the arcuate portion 151 is large, and hence the tip end surfaces 41 of the magnetic poles 4*b* are arranged to get close to the outer surface 105*a* of the tip end of the electric field relaxing electrode 105, and a distance D3 between the outer surface (the outer surface of the arcuate portion 151) 105*a* of the tip portion of the electric field relaxing electrode 105 and the tip end surfaces 41 of the magnetic poles 4*b* is smaller than the distance D1 according to the aforementioned first embodiment. The distance D3 is not more than the length L1 of each of the magnetic poles 4*b* in the axial direction A. A distance between the outer surface 105*a* of a tip end of the arcuate portion 151 and the outer peripheral surface 31*a* of a cylindrical portion 31 of the envelope 3 is D4.

The inclined portions 152 are inclined at an inclination angle substantially equal to the inclination angle θ of the inclined surfaces 32*a* (the outer peripheral surfaces of the inclined portions 32) of the envelope 3 and are formed to extend substantially parallel to the inclined surfaces 32*a*. The envelope 3 is bilaterally symmetric in a section taken along a rotation axis 3*a* (central axis), and hence in correspondence to this, the inclined portions 152 are also bilaterally symmetric through the arcuate portion 151 in the section taken along the rotation axis 3*a* (central axis). Thus, a distance between the inclined portions 152 (outer surface 105*a*) and the inclined surfaces 32*a* of the envelope 3 that is D5 is substantially constant. In the inclined portions 152, ends 153 opposite to the arcuate portion 151 each are also formed in a rounded smooth shape.

As shown in FIG. 5, the electric field relaxing electrode 105 is annularly provided to cover all four magnetic poles 4*b* in a transverse section (a 600-600 section in FIG. 5) in a direction orthogonal to the rotation axis (central axis) 3*a*, and the outer surface 105*a* of the tip end (the tip end of the arcuate portion 151) of the electric field relaxing electrode 105 is formed of a circular inner peripheral surface, similarly to the aforementioned first embodiment. The inner peripheral surface (outer surface 105*a*) of the electric field relaxing electrode 105 is arranged such that the distance D4 therefrom to the outer peripheral surface 31*a* of the cylindrical portion 31 of the envelope 3 is substantially constant.

The remaining structure of the second embodiment is similar to that of the aforementioned first embodiment.

According to the second embodiment, as hereinabove described, the outer surface 105*a* of the tip end of the electric field relaxing electrode 105 is formed in the shape corresponding to the outer shape of the envelope 3 in the axial direction A. According to this structure, a change in the distance D4 between the outer surface 105*a* of the electric field relaxing electrode 105 and the outer peripheral surface of the envelope 3 in the axial direction A can be suppressed, and hence electric field concentration in the electric field relaxing electrode 105 in the axial direction A can be effectively relaxed.

According to the second embodiment, as hereinabove described, the outer surface 105*a* of the tip end of the electric field relaxing electrode 105 has the sectional shape in which the arcuate portion 151 covering the tip end surfaces 41 of the magnetic poles 4*b* and the inclined portions 152 extending substantially parallel to the inclined surfaces 32*a* of the envelope 3 smoothly continue in the longitudinal section in the axial direction A. According to this structure, the arcuate portion 151 of the electric field relaxing electrode 105 can relax electric field concentration in the tip ends of the magnetic poles 4*b*, and the inclined portions 152 of the electric field relaxing electrode 105 smoothly continuing to the arcuate portion 151 are substantially parallel to the inclined surfaces 32*a* of the envelope 3, and hence electric fields between the inclined portions 152 and the inclined surfaces 32*a* can be brought close to a uniform state. Thus, the electric field concentration on the outer surface 105*a* of the electric field relaxing electrode 105 can be further effectively relaxed.

EXAMPLES

Simulations (Examples) of field intensity conducted in order to confirm the effects of the present invention are now described with reference to FIGS. 7 to 9.

In Examples, simulations of field intensity in regions between the tip end portions of the magnetic poles of the magnetic field generators and the envelopes in the X-ray tube device 100 (Example 1) according to the aforementioned first embodiment and the X-ray tube device 200 (Example 2) according to the aforementioned second embodiment were conducted. As Comparative Example, a simulation about an example (Comparative Example) of providing no electric field relaxing electrode was conducted and was compared with Examples. Simulation conditions such as the dimensions of the envelope and the magnetic poles and the potentials of the envelope 3 and the magnetic poles 4*b* are common in Examples 1 and 2 and Comparative Example.

Figure 7:
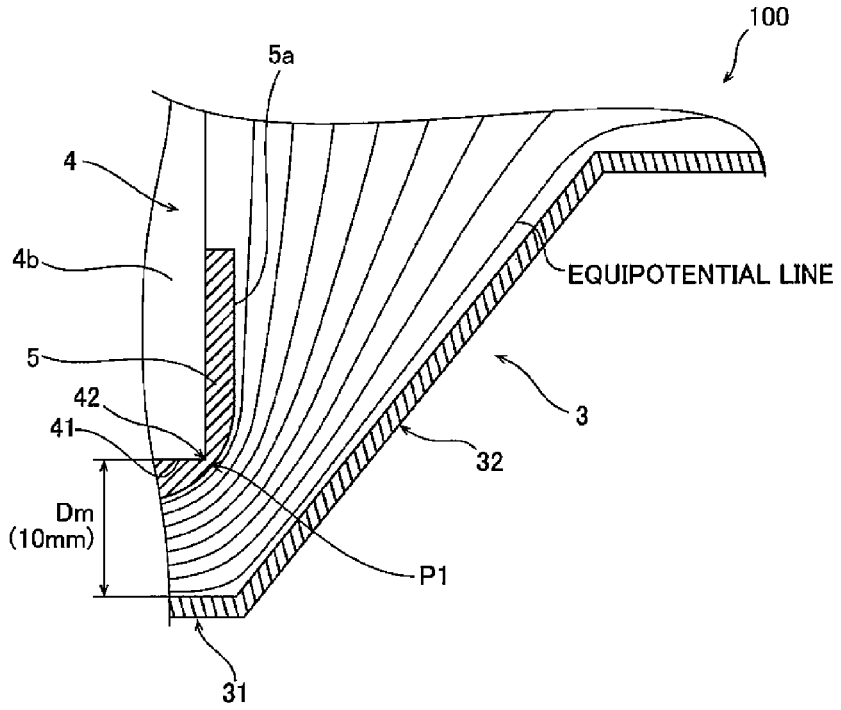
FIG. 7 A schematic view showing a result of a simulation of field intensity in the vicinity of a tip end of a magnetic pole of a magnetic field generator according to Example 1 of the present invention.

FIG. 7 shows a result of the simulation in Example 1. In Example 1, a distance Dm (D1+D2) from the tip end surfaces 41 of the magnetic poles 4*b* of the magnetic field generator 4 to the outer peripheral surface 31*a* of the envelope 3 (cylindrical portion 31) was set to 10 mm.

Figure 8:
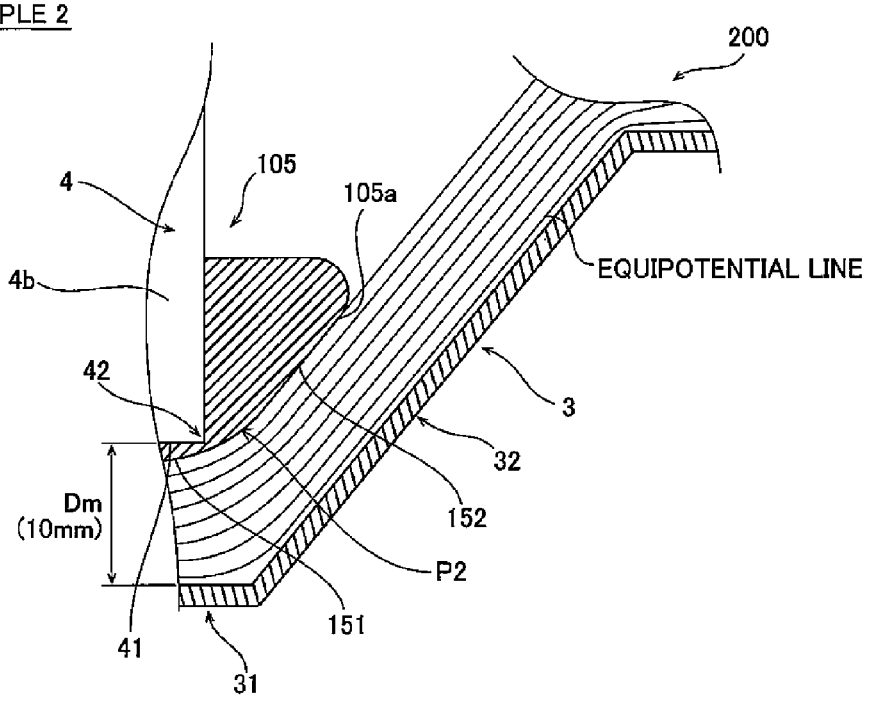
FIG. 8 A schematic view showing a result of a simulation of field intensity in the vicinity of a tip end of a magnetic pole of a magnetic field generator according to Example 2 of the present invention.

FIG. 8 shows a result of the simulation in Example 2. In Example 2, a distance Dm (D3+D4) from the tip end surfaces 41 of the magnetic poles 4*b* of the magnetic field generator 4 to the outer peripheral surface 31*a* of the envelope 3 (cylindrical portion 31) was set to 10 mm. Example 2 is different from the aforementioned Example 1 only in the shape of the electric field relaxing electrode.

Figure 9:
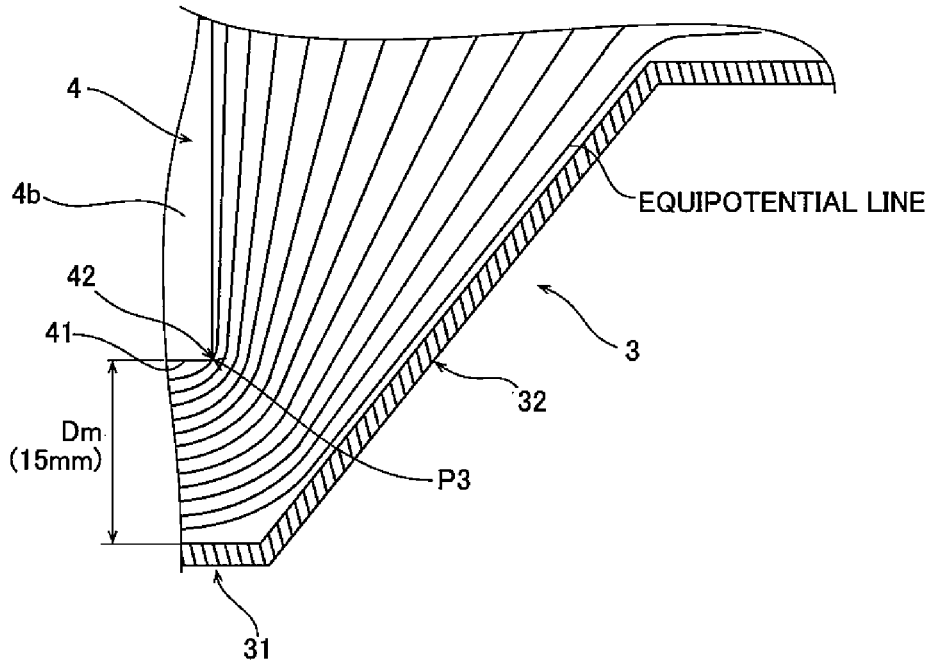
FIG. 9 A schematic view showing a result of a simulation of field intensity in the vicinity of a tip end of a magnetic pole of a magnetic field generator according to Comparative Example.

FIG. 9 shows a result of the simulation in Comparative Example. In Comparative Example, a distance Dm from tip end surfaces 41 of magnetic poles 4*b* of a magnetic field generator 4 to the outer peripheral surface 31*a* of an envelope 3 (cylindrical portion 31) was set to 15 mm. Comparative Example is different from the aforementioned Example 1 and Example 2 in that no electric field relaxing electrode is provided and the distance Dm is set to be large as compared with Example 1 and Example 2.

As shown in FIG. 7, the field intensity was maximized on the outer surface 5*a* (P1) of the electric field relaxing electrode 5 in the vicinity of a corner portion 42 of a magnetic pole 4*b* and was 12 kV/mm in Example 1. As shown in FIG. 8, the field intensity was maximized on the outer surface 5*a* (P2) in the vicinity of a boundary between the arcuate portion 151 and an inclined portion 152 of the electric field relaxing electrode 105 and was 10.6 kV/mm in Example 2. As shown in FIG. 9, the field intensity was maximized at a corner portion 42 (P3) of a tip end of the magnetic pole 4*b* and was 18.8 kV/mm in Comparative Example. In the condition setting according to these Examples, there is a possibility of discharge in the vicinity of the field intensity 20 kV/mm, and discharge can be sufficiently prevented if the field intensity is in the vicinity of 10 kV/mm.

In Comparative Example, as described above, electric field concentration was generated at the corner portion 42 of the magnetic pole 4*b* where high field intensity was exhibited even in a state where the distance Dm from the tip end surface 41 of the magnetic pole 4*b* to the outer peripheral surface of the envelope 3 was set to 15 mm. Thus, under the conditions of Comparative Example, it is difficult to set a distance between the magnetic pole 4*b* and the envelope 3 to not more than Dm (=15 mm) in order to prevent generation of discharge starting from the corner portion 42 of the magnetic pole 4*b*. In Examples 1 and 2, on the other hand, the field intensity can be suppressed to a degree slightly exceeding 10 kV/mm even if the distance Dm is set to 10 mm. From these, the effect of relaxing the electric field concentration in the tip end of the magnetic pole 4*b* by the electric field relaxing electrode has been confirmed, and it has been confirmed that the magnetic pole 4*b* can be placed closer to the envelope 3.

From the comparison between Example 1 and Example 2, it has been proved that according to Example 2, the electric field concentration on the outer surface of the electric field relaxing electrode can be further relaxed in the condition setting in which only the shape of the electric field relaxing electrode is different. From this, it has been confirmed that the effect of relaxing the electric field concentration is improved by the structure according to Example 2 (aforementioned second embodiment) in which the electric field relaxing electrode is formed in correspondence to the shape of the envelope.

The embodiments and Examples disclosed this time must be considered as illustrative in all points and not restrictive. The range of the present invention is shown not by the above description of the embodiments and Examples but by the scope of claims for patent, and all modifications within the meaning and range equivalent to the scope of claims for patent are further included.

For example, while the example of applying the present invention to the envelope rotation type X-ray tube device has been shown in each of the aforementioned first and second embodiments, the present invention is not restricted to this. The present invention may be applied to an X-ray tube device other than the envelope rotation type X-ray tube device, such as an anode rotation type X-ray tube device in which only an envelope is fixed or an anode fixed X-ray tube device, for example.

While the example of providing the U-shaped electric field relaxing electrode in the longitudinal section in the axial direction has been shown in the aforementioned first embodiment and the example of providing the electric field relaxing electrode including the arcuate portion and the inclined portions in the longitudinal section in the axial direction has been shown in the aforementioned second embodiment, the present invention is not restricted to this. For example, the longitudinal section of the electric field relaxing electrode may be in a completely arcuate shape (sectorial shape, semicircular shape, or the like) or a curved surface shape other than the arcuate shape. It is only required to form the electric field relaxing electrode to have a rounded outer surface in order to be capable of relaxing the electric field concentration at the corner portions.

While the example of forming the electric field relaxing electrode to completely cover the corner portions of the tip ends, the tip end surface, and the portions of the side surfaces closer to the tip ends of the magnetic poles has been shown in each of the aforementioned first and second embodiments, the present invention is not restricted to this. According to the present invention, the corner portions of the tip ends, the tip end surface, and the side surfaces of the magnetic poles may be partially covered.

While the example of making the electric field relaxing electrode of the non-magnetic metal material has been shown in each of the aforementioned first and second embodiments, the present invention is not restricted to this. According to the present invention, the electric field relaxing electrode may be made of a non-magnetic material other than metal. Alternatively, the electric field relaxing electrode may be made of a magnetic material so far as the magnetic field generated by the electric field generator can act on the electron beam.

Figure 10:
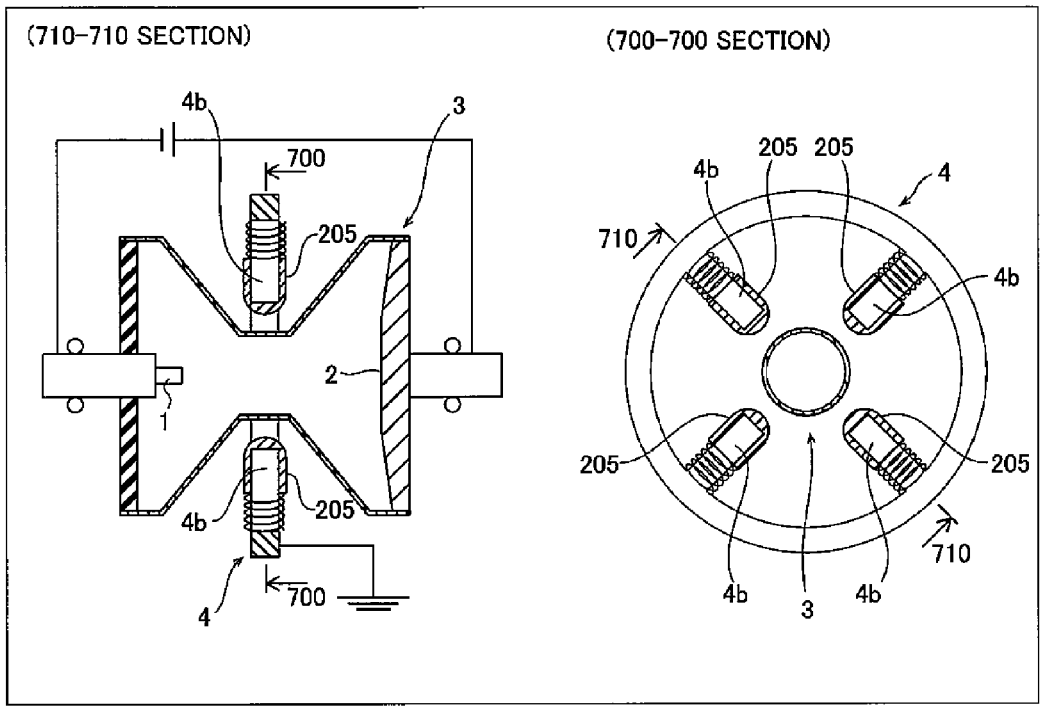
FIG. 10 A schematic view for illustrating an electric field relaxing electrode of an X-ray tube device according to a first modification of the first and second embodiments of the present invention.

While the example of annularly forming the electric field relaxing electrode in the transverse section orthogonal to the axial direction and providing the electric field relaxing electrode to cover the plurality of electric poles has been shown in each of the aforementioned first and second embodiments, the present invention is not restricted to this. For example, an electric field relaxing electrode 205 may be provided individually for each of a plurality of magnetic poles 4*b*, as in a first modification shown in FIG. 10.

Figure 11:
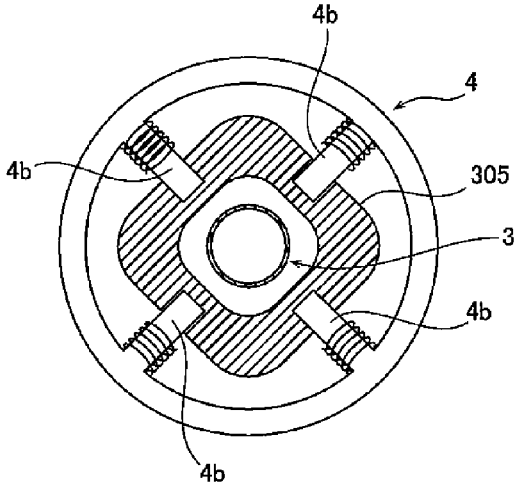
FIG. 11 A schematic view for illustrating an electric field relaxing electrode of an X-ray tube device according to a second modification of the first and second embodiments of the present invention.

While the example of annularly forming the electric field relaxing electrode in the transverse section orthogonal to the axial direction has been shown in each of the aforementioned first and second embodiments, the present invention is not restricted to this. For example, an electric field relaxing electrode having a shape other than the annular shape, such as an electric field relaxing electrode 305 having rounded corners may be provided, as in a second modification shown in FIG. 11. In the electric field relaxing electrode 305 shown in FIG. 11, only the inner peripheral surface may be circularly formed.

While the example of arranging the annular electric field relaxing electrode concentrically to the cylindrical portion of the envelope in the transverse section orthogonal to the axial direction has been shown in each of the aforementioned first and second embodiments, the present invention is not restricted to this. According to the present invention, the center of the electric field relaxing electrode may be deviated from the axial center of the tubular envelope.

While the example in which the distance D2 (D4) between the inner peripheral surface of the annular electric field relaxing electrode and the outer surface of the envelope is substantially constant in the circumferential direction in the transverse section orthogonal to the axial direction has been shown in each of the aforementioned first and second embodiments, the present invention is not restricted to this. According to the present invention, the electric field relaxing electrode may be formed such that the distance between the outer surface of the electric field relaxing electrode and the outer surface of the envelope is varied according to a position in the circumferential direction.

While the example of setting the distance between the outer surface 105*a* of the tip end of the arcuate portion 151 and the outer peripheral surface 31*a* of the cylindrical portion 31 of the envelope 3 to D4 and setting the distance between the inclined portions 152 and the inclined surfaces 32*a* of the envelope 3 to D5 that is substantially constant has been shown in the aforementioned second embodiment, the present invention is not restricted to this. According to the present invention, the electric field relaxing electrode may be formed such that the distance D4 and the distance D5 are equal to each other.

While the example of providing the electric field relaxing electrode to cover only the tip end portions of the magnetic poles around which the coils are not wound has been shown in each of the aforementioned first and second embodiments, the present invention is not restricted to this. According to the present invention, the electric field relaxing electrode may be formed to also cover portions around which the coils are wound.

While the example of providing the electric field relaxing electrode having a solid structure has been shown in each of the aforementioned first and second embodiments, the present invention is not restricted to this. According to the present invention, an electric field relaxing electrode having a hollow structure may be provided.

While the example of forming the electric field relaxing electrode such that the distance D1 (D3) between the outer surface of the electric field relaxing electrode and the tip end surfaces of the magnetic poles is not more than the length L1 of each of the magnetic poles in the axial direction has been shown in each of the aforementioned first and second embodiments, the present invention is not restricted to this. According to the present invention, the electric field relaxing electrode may be formed such that the distance between the outer surface of the electric field relaxing electrode and the tip end surfaces of the magnetic poles is more than the length of each of the magnetic poles in the axial direction.

While the example of providing the magnetic field generator including the four magnetic poles has been shown in each of the aforementioned first and second embodiments, the present invention is not restricted to this. According to the present invention, the number of magnetic poles may be a plural number other than four, and two, six, or eight magnetic poles may be provided, for example. The number of magnetic poles may be any number so far as an intended magnetic field is obtained.

While the example of providing each of the magnetic poles in a rectangular columnar shape has been shown in each of the aforementioned first and second embodiments, the present invention is not restricted to this. According to the present invention, the magnetic poles each may be provided in a shape other than the rectangular columnar shape, such as a circular columnar shape, for example.

While the example of providing the inclined portions inclined such that the diameter is increased toward both ends in the axial direction A in the envelope has been shown in each of the aforementioned first and second embodiments, the present invention is not restricted to this. For example, an envelope having an inclined portion only on the side of a target and having such a shape that a cylindrical portion directly extends in an axial direction on the side of an electron source may be provided.

While the example of providing the envelope made of the metal material such as stainless steel has been shown in each of the aforementioned first and second embodiments, the present invention is not restricted to this. According to the present invention, the envelope may be made of a material other than metal. The envelope may be made of an insulating material such as ceramic, for example.

While the example in which the envelope 3 is bilaterally symmetric in the section taken along the rotation axis 3*a* (central axis) has been shown in each of the aforementioned first and second embodiments, the present invention is not restricted to this. According to the present invention, the diameters of the insulating member 33 and the target 2 may not be the same, and the envelope 3 may be bilaterally symmetric in the section taken along the rotation axis 3*a* (central axis).

While the example in which the tip ends of the magnetic poles are shaped to have the corner portions has been shown in each of the aforementioned first and second embodiments, the present invention is not restricted to this. According to the present invention, the tip ends of the magnetic poles may not be shaped to have the corner portions but each may be shaped to have a curvature radius smaller than L½.

REFERENCE NUMERALS

1: electron source (cathode)
2: target (anode)
3: envelope
4: magnetic field generator
4*a*: core
4*b*: magnetic pole
4*c*: coil
5, 105, 205, 305: electric field relaxing electrode
5*a*: outer surface
31*a*: outer peripheral surface
32*a*: inclined surface
41: tip end surface
42: corner portion
43: side surface
51, 151: arcuate portion
53: recess portion
152: inclined portion
100, 200: X-ray tube device

The invention claimed is:

1. An X-ray tube device comprising:
a cathode generating an electron beam;
an anode generating an X-ray by collision of the electron beam from the cathode;
an envelope internally housing the cathode and the anode;
a magnetic field generator including a magnetic pole arranged to be opposed to the envelope, generating a magnetic field for focusing and deflecting the electron beam from the cathode to the anode; and
an electric field relaxing electrode arranged between the magnetic pole and the envelope, having an outer surface having a rounded shape.

2. The X-ray tube device according to claim 1, wherein
the outer surface having the rounded shape of the electric field relaxing electrode is arranged in a vicinity of a tip end of the magnetic pole.

3. The X-ray tube device according to claim 2, wherein
the tip end of the magnetic pole is shaped to have a corner portion, and
the outer surface having the rounded shape of the electric field relaxing electrode is provided to cover at least the corner portion of the tip end of the magnetic pole.

4. The X-ray tube device according to claim 3, wherein
the electric field relaxing electrode is provided to cover the corner portion of the tip end of the magnetic pole and a tip end surface and a side surface that intersect with each other at the corner portion of the magnetic pole.

5. The X-ray tube device according to claim 4, wherein
the electric field relaxing electrode is provided to tightly surround and cover the corner portion of the tip end of the magnetic pole and the tip end surface.

6. The X-ray tube device according to claim 1, wherein
the electric field relaxing electrode is made of non-magnetic metal.

7. The X-ray tube device according to claim 1, wherein
the envelope has a tubular shape housing the cathode and the anode, and the electric field relaxing electrode is annularly provided to surround the envelope having the tubular shape.

8. The X-ray tube device according to claim 7, wherein the outer surface of a tip end of the electric field relaxing electrode that is annular is formed in a convex rounded shape in a longitudinal section in a direction along a central axis line of the envelope having the tubular shape, and the outer surface of the tip end of the electric field relaxing electrode that is annular is formed of a circular inner peripheral surface in a transverse section in a direction orthogonal to the central axis line of the envelope.

9. The X-ray tube device according to claim 7, wherein a plurality of the magnetic poles are provided at prescribed angular intervals around the envelope, and the electric field relaxing electrode includes the electric field relaxing electrode that is single and annular, provided to cover the plurality of magnetic poles.

10. The X-ray tube device according to claim 9, wherein the magnetic field generator includes an annular core and the plurality of magnetic poles arranged to protrude inward from the annular core, a plurality of recess portions into which tip end portions of the plurality of magnetic poles are inserted are provided in an outer peripheral portion of the electric field relaxing electrode that is annular, and the tip end portions of the plurality of magnetic poles are covered with the electric field relaxing electrode that is annular by insertion of the plurality of magnetic poles into the plurality of recess portions of the electric field relaxing electrode that is annular.

11. The X-ray tube device according to claim 7, wherein the electric field relaxing electrode that is annular is arranged concentrically to the envelope to surround the envelope.

12. The X-ray tube device according to claim 7, wherein an inner peripheral surface of the electric field relaxing electrode that is annular is arranged such that a distance therefrom to an outer peripheral surface of the envelope is substantially constant.

13. The X-ray tube device according to claim 12, wherein the envelope having the tubular shape has a circular outer peripheral surface in a transverse section in a direction orthogonal to a central axis line of the envelope, and the inner peripheral surface of the electric field relaxing electrode that is annular has a circular shape and is arranged such that the distance therefrom to the outer peripheral surface of the envelope is substantially constant.

14. The X-ray tube device according to claim 1, wherein the electric field relaxing electrode has a convex outer surface, and the convex outer surface of the electric field relaxing electrode includes an arcuate portion covering a tip end surface of the magnetic pole.

15. The X-ray tube device according to claim 14, wherein the arcuate portion of the electric field relaxing electrode has a curvature radius larger than a half of a length of the magnetic pole in a direction along an orientation of the electron beam.

16. The X-ray tube device according to claim 1, wherein the outer surface of a tip end of the electric field relaxing electrode has a shape corresponding to an outer shape of the envelope in a direction along an orientation of the electron beam.

17. The X-ray tube device according to claim 16, wherein the envelope has a tubular shape having a circular section and has an inclined surface inclined such that a diameter outward in a direction along a central axis line is larger, and the outer surface of the tip end of the electric field relaxing electrode has a sectional shape in which an arcuate portion covering a tip end surface of the magnetic pole and an inclined portion extending substantially parallel to the inclined surface smoothly continue in a longitudinal section of the envelope in the direction along the central axis line.

18. The X-ray tube device according to claim 1, wherein a coil is wound around a base portion side of the magnetic pole, and the electric field relaxing electrode covers a tip end portion of the magnetic pole around which the coil is not wound.

19. The X-ray tube device according to claim 1, wherein the electric field relaxing electrode is arranged to cover at least a tip end surface of the magnetic pole, and a distance between the outer surface of the electric field relaxing electrode and the tip end surface of the magnetic pole is not more than a length of the magnetic pole in a direction along an orientation of the electron beam.

20. The X-ray tube device according to claim 1, wherein the envelope has a tubular shape housing the cathode and the anode centering on an axis and rotates integrally with the anode.

* * * * *